US007237488B2

(12) United States Patent
Duescher et al.

(10) Patent No.: US 7,237,488 B2
(45) Date of Patent: Jul. 3, 2007

(54) FIREWORKS BOTTLE ROCKET LAUNCHER

(76) Inventors: Cameron Michael Duescher, 276 Janice Ave., Shoreview, MN (US) 55126; Kent Wayne Duescher, 276 Janice Ave., Shoreview, MN (US) 55126

( * ) Notice: Subject to any disclaimer, the term of this patent is extended or adjusted under 35 U.S.C. 154(b) by 202 days.

(21) Appl. No.: 11/066,916

(22) Filed: Feb. 25, 2005

(65) Prior Publication Data

US 2006/0191402 A1 Aug. 31, 2006

(51) Int. Cl.
*F42B 4/06* (2006.01)
*F42B 4/20* (2006.01)

(52) U.S. Cl. ..... 102/349; 102/358

(58) Field of Classification Search ..... 89/1.815, 89/1.35, 1.82, 37.05, 40; 102/343, 344, 347, 102/349, 355, 356, 358, 361
See application file for complete search history.

(56) References Cited

U.S. PATENT DOCUMENTS

| | | | | | |
|---|---|---|---|---|---|
| 29,118 | A | | 7/1860 | Woodward | 102/343 |
| 1,003,082 | A | | 9/1911 | Ziegenfuss | 102/338 |
| 1,776,354 | A | | 9/1930 | Edmunds | 248/520 |
| 2,005,826 | A | | 6/1935 | Kulp et al. | 248/520 |
| 2,306,442 | A | | 12/1942 | Holmes | 102/343 |
| 2,380,024 | A | * | 7/1945 | Chandler | 89/13.05 |
| 2,795,386 | A | | 6/1957 | Elsey | 248/520 |
| 2,923,240 | A | | 2/1960 | Blewer | 102/344 |
| 2,993,297 | A | | 7/1961 | Bednar et al. | 446/197 |
| 3,190,033 | A | | 6/1965 | Wood | 446/14 |
| 3,739,764 | A | | 6/1973 | Allport | 124/70 |
| 4,076,006 | A | | 2/1978 | Breslow et al. | 124/64 |
| 4,128,039 | A | * | 12/1978 | Skliris | 89/1.803 |
| 4,148,258 | A | | 4/1979 | Powers | 102/343 |
| 4,198,897 | A | * | 4/1980 | Lipp et al. | 89/13.05 |
| 4,411,249 | A | | 10/1983 | Fogarty et al. | 124/64 |
| 4,429,611 | A | | 2/1984 | Oldham et al. | 89/1.816 |
| 4,724,768 | A | | 2/1988 | Robinson et al. | 102/349 |
| 4,917,015 | A | | 4/1990 | Lowery | 102/342 |
| 5,339,741 | A | | 8/1994 | Craven et al. | 102/361 |
| 5,433,646 | A | | 7/1995 | Tarng | 446/473 |

(Continued)

*Primary Examiner*—Stephen M. Johnson
*Assistant Examiner*—Bret Hayes
(74) *Attorney, Agent, or Firm*—Mark A. Litman & Associates, P.A.

(57) ABSTRACT

A bottle rocket launcher comprises a long hollow tube barrel having an tube-axial sealing valve that has a rotary cylindrical or spherical valve member where the valve is attached at the breech end of the launcher barrel. The rocket launcher can be angled up to a near vertical position with support legs. In use, a bottle rocket can be partially inserted into the valve passageway that is held open. The flammable rocket fuse is lit and the bottle rocket is dynamically inserted by hand contact with the rocket stick into the barrel inside chamber body to a position that is beyond the valve member. The valve is rotated into a valve-closed position while the rocket fuse is burning. When the bottle rocket powder is ignited by the burning fuse, the burning exhaust gases thrusts the bottle rocket along the inside of the barrel tube and propels it into the sky in the direction that the launcher barrel is pointed. The rocket exhaust gasses are all restricted to the valve sealed interior confirms of the launch barrel, which protects the operator from the gases or from a premature explosion of the rocket. The launch tube may be independently supported on the surface of the ground or the launch tube may be used as a hand-held device.

10 Claims, 7 Drawing Sheets

U.S. PATENT DOCUMENTS

| | | | | |
|---|---|---|---|---|
| 5,496,025 | A | 3/1996 | Phillips et al. | 124/56 |
| 5,538,453 | A | 7/1996 | Johnson | 446/176 |
| 5,553,598 | A | 9/1996 | Johnson et al. | 124/63 |
| 5,619,980 | A | 4/1997 | Lee et al. | 124/64 |
| 5,691,500 | A | 11/1997 | Mancini | 102/361 |
| 5,819,717 | A | 10/1998 | Johnson et al. | 124/65 |
| 5,826,750 | A | 10/1998 | Johnson | 222/79 |
| 5,839,940 | A | 11/1998 | Ensmenger | 446/212 |
| 5,881,706 | A | 3/1999 | Carson | 124/69 |
| 6,315,629 | B1 | 11/2001 | Jones | 446/212 |
| 6,347,623 | B1 | 2/2002 | Kownacki et al. | 124/56 |
| 6,457,415 | B1 * | 10/2002 | Peter Sung Yan | 102/361 |

* cited by examiner

FIREWORKS BOTTLE ROCKET LAUNCHER

BACKGROUND OF THE ART

1. Field of the Invention

The present invention relates to the launching of fireworks in the form of bottle rockets and to devices that assist in the launching of the rockets.

2. Background of the Invention

Fireworks bottle rockets are pyrotechnic devices that have a quantity of flammable powder enclosed in an elongated paper tube that is attached at the head end of a long, thin stick. The tube axial body is aligned parallel to the stick to provide a rocket lifting thrust that is directed parallel to the stick when powder inside the tube is ignited. A flammable thin and flexible fuse that extends out from the base end of the powder tube is used to ignite the powder inside the tube. The bottle rocket stick is typically supported within a beverage bottle that has a tapered shape where the bottle has a small bottle top opening on one end and a larger flat bottom continuous surface on the opposing end. Use of these stick-mounted flammable powder fireworks tubes, which act as rockets, along with bottles that are used as holding and pointing devices originates the name "bottle rockets". When used as a launcher, the bottle is positioned upright with its flat bottom surface lying flat on the ground and the bottle in a near vertical orientation. A bottle rocket stick base is inserted into the bottle small top mouth opening where the base of the stick contacts the bottle bottom flat surface. Here, the bottle freely confines the stick portion of the bottle rocket, as the stick diameter is very small compared to the bottle-top opening. As the bottle rocket is loosely contained in the upright bottle, the bottle rocket stick axis assumes a near vertical alignment direction. However, the diameter of the base area of the bottle is very large compared to the diameter of the stick, which allows the base of the stick to be randomly positioned on one side or another of the bottle. This random position of the stick base results in a wide variation in the vertical orientation of the bottle rocket stick where the initial incline angle can be inadvertently changed during the launch procedure. It is usually assumed that the bottle rocket flight trajectory will initially start in the direction of the bottle axis as the bottle contains and supports the bottle rocket stick. Because the stick can freely move around within the bottle, the launch angle can also change from that which is intended. It is not possible to have a consistent aimed trajectory of bottle rockets when using a open moth bottle as a launch device. The rocket stick is sufficiently long that when it is inserted into the bottle top opening, the base end of the stick contacts the bottom surface of the bottle and the tubular fireworks rocket portion of the bottle rocket extends upward some distance away from the top surface of the bottle. Here, both the full length of the rocket powder tube and the fuse extend somewhat above the top end of the bottle to allow the fuse to be easily accessed for flame lighting. Upon lighting the end of the flexible fuse, a wall of burning fire travels along the length of the fuse until the fire ignites the leading edge of the flammable powder matrix located in the fuse-end of the powder tube. When the fuse is first lighted, the fuse fire-line slowly progresses up the length of the fuse, which provides a time delay between the time that the fuse is first lit, and the time when the tube-contained powder starts to burn. This time delay allows the operator to light a fuse and then to move away from the bottle rocket for safety reasons before the rocket tube powder burn is initiated. The powder located in the stick base portion of the paper tube is lit first and the gases that are generated by the burning powder are directed out the rear portion of the tube along the axis of the stick. This burning gas provides a propelling force that is also directed along the axial length of the stick. The exhaust gas force accelerates the bottle rocket unit out of the loose-confines of the bottle in a direction that is initially along the axis of the rocket stick as it was held in position by the bottle. Powder burns progressively within the paper tube and continuously thrusts the rocket to a greater speed and a higher elevation. A rocket usually assumes a curved trajectory due to gravity forces acting on the rocket body during flight. The rocket can provide a continuous fireworks display of burning particles and a powder-burn sound as it travels up into the air. At the end of the powder-burning event which occurs at or close to the apex of the rocket flight, a pyrotechnic explosion typically occurs when a cached quantity of powder, located in the forward or head end of the tube, is ignited.

There are a number of trajectory guidance and safety issues when this traditional bottle holding system is used to ignite and release an activated bottle rocket into the atmosphere. First, it is desirable for the operator to have a method to control the rocket flight trajectory by hand during launch rather than using the passive bottle orientation guidance system. Second, there are a number of safety issues related to different events that always occur or occasionally occur during the launch procedure. In the instance where the fuse is defective and a slow fuse burn rate the main firing of the rocket thrust powder occurs some longer time after the expected delay has passed. Prior to the actual delayed tube-powder firing event, the unaware operator can mistakenly re-approach or even handle the bottle rocket, at which time it can fully ignite or explode. In another instance, if the glass bottle has been structurally weakened or it is fragile in its original state compared to the rocket explosive power, a defective rocket may explode prior to leaving the confines of the glass, which could fracture the glass. If an operator is directly adjacent to the glass bottle when the glass fracture occurs, flying glass fragments could harm the operator or other observers. Some bottle rockets are quite powerful but they are limited in use because they are also more expensive than more common varieties. These powerful bottle rockets are much more dangerous than the common variety types. In addition, positioning a bottle on an uneven or a non-stable ground surface can result in the bottle tipping over during the launch event which can direct the rocket to be propelled in unwanted directions. At other times, a bottle is not used to support a bottle rocket. Instead, the bottle rocket stick is inserted into sand or is held by rocks. Upon ignition, the sand or rocks may firmly grasp the stick and restrain it against the propelling force of the rocket, which prevents the rocket from rising into the air and traveling to areas that are remote from the operator and observers before the final pyrotechnic explosion. In this case the flare of the burning rocket is directed against the ground and the final rocket explosion event occurs also at the immediate ground level. Undesirable launch events can have a damaging effect on adjacent ground materials, operators or observers. There is not a practical safe method for an operator to hold a beverage bottle launch device by hand to direct the flight of the bottle rocket. If a bottle is held by hand during launch, the exhaust plume from the rocket can easily impact the hand or eyes of the operator. Bottle rockets should not be used by children as they are not sophisticated in knowing the techniques required for safe and interesting launching of bottle rockets. A simple but intuitive launcher device that is strong and safe and which has attributes that trigger awareness of important and desirable launch techniques can make it easier to consistently have enjoyable but safe and successful launches. Protection of both the operator and observers from exhaust flames or explosions during launch is very important.

A number of rocket or propellant launch devices are described in U.S. Pat. No. 29,118 (Woodward), U.S. Pat. No. 1,003,082 (Ziegenfuss), U.S. Pat. No. 1,776,354 (Edmands), U.S. Pat. No. 2,005,826 (Kulp et al.), U.S. Pat. No. 2,306,442 (Holmes), U.S. Pat. No. 2,795,386 (Elsey), U.S. Pat. No. 2,923,240 (Blewer), U.S. Pat. No. 2,993,297 (Bednar et al.), U.S. Pat. No. 3,190,033 (Wood), U.S. Pat. No. 3,739,764 (Allport), U.S. Pat. No. 4,076,006 (Bestow et al.), U.S. Pat. No. 4,148,258 (Powers), U.S. Pat. No. 4,411,249 (Fogarty et al.), U.S. Pat. No. 4,429,611 (Oldham et al.), U.S. Pat. No. 4,724,768 (Robinson et al.), U.S. Pat. No. 4,917,015 (Lowery), U.S. Pat. No. 5,339,741 (Craven et al.), U.S. Pat. No. 5,433,646 (Tamg), U.S. Pat. No. 5,496,025 (Phillips et al.), U.S. Pat. No. 5,538,453 (Johnson), U.S. Pat. No. 5,553,598 (Johnson et al.), U.S. Pat. No. 5,619,980 (Lee et al.), U.S. Pat. No. 5,691,500 (Mancini), U.S. Pat. No. 5,819,717 (Johnson et al.), U.S. Pat. No. 5,826,750 (Johnson), U.S. Pat. No. 5,839,940 (Ensmenger), U.S. Pat. No. 5,881,706 (Carson), U.S. Pat. No. 6,315,629 (Jones), and U.S. Pat. No. 6,347,623 (Kownacki et al.).

SUMMARY OF THE INVENTION

The bottle rocket launcher described herein comprises a hollow barrel having a breech valve or side load breach mounted on one end of the barrel. The breech valve through-hole opening is aligned with the inside diameter of the launcher barrel by rotating a valve lever. A bottle rocket is partially inserted into the launcher through an open breech valve, the rocket fuse is lit, the rocket is quickly thrust fully into the barrel, the valve is closed and the rocket is then launched out of the barrel upon ignition of the rocket flammable powder. With a side breech load, the side panel is opened, the lit rocket dropped in, and the side panel closed (and preferably locked).

All of the individual rocket launcher components can be constructed of inexpensive, non-corrosive but strong materials including structural PVC (poly vinyl chloride), plated steel, copper, or other materials, or combinations of these materials.

DETAILED DESCRIPTION OF THE INVENTION

Figure 1:
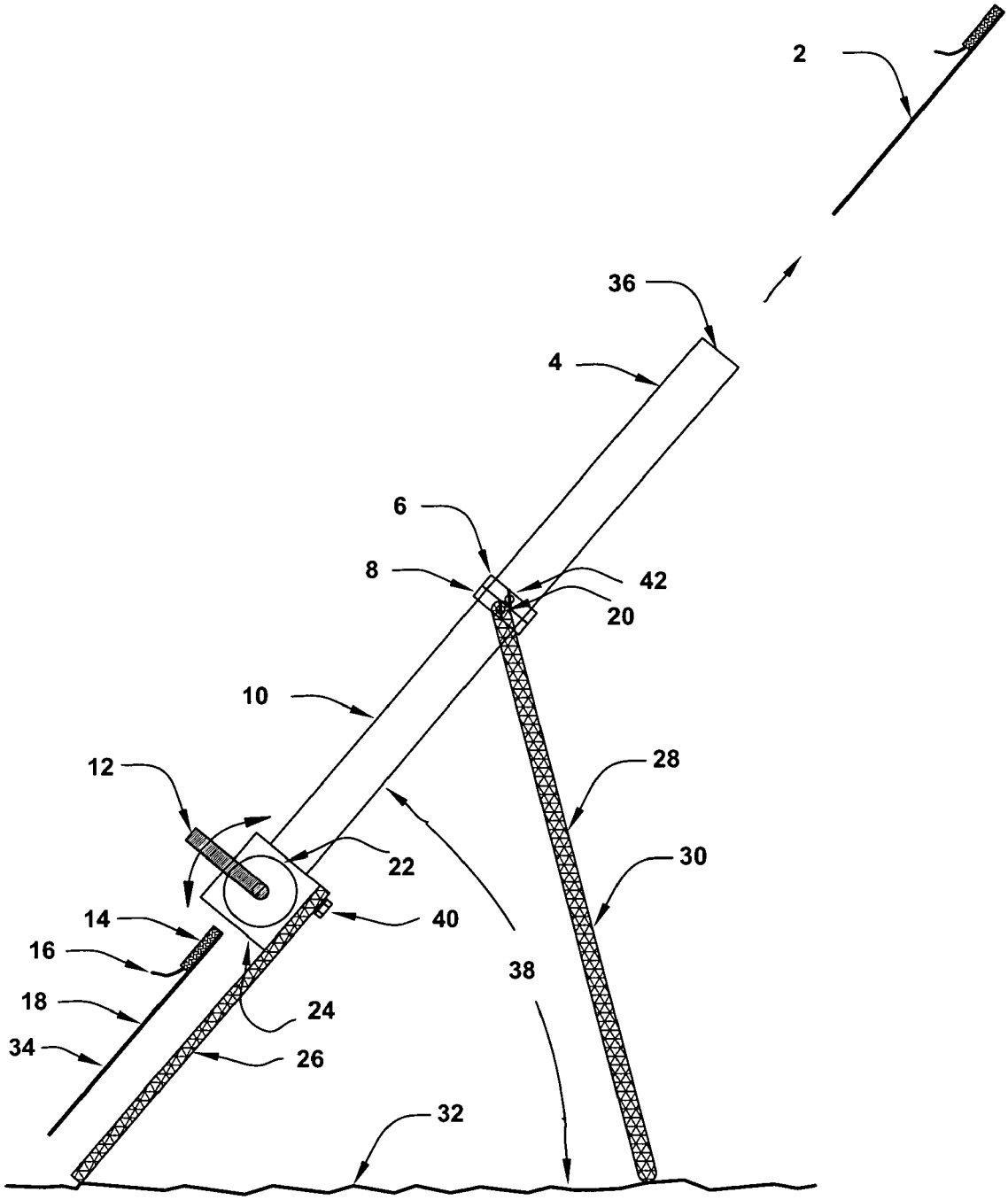
FIG. 1 shows a side view of a bottle rocket launcher.

A bottle rocket launcher apparatus is described that provides the following sequence of events during a rocket launch. First, a bottle rocket is partially inserted into a launcher valve opening, the exposed rocket fuse is lighted by a flame, the fuse-lit rocket is fully inserted into the launcher barrel chamber, the valve is closed to seal-off the launcher barrel chamber after which the burning fuse ignites the rocket flammable powder which propels the rocket along the length of the launcher barrel to cause it to exit the barrel in a direction along the axis of the barrel. The burning exhaust powered rocket is accelerated to greater heights until the thrust powder is consumed. Then a reservoir of powder is ignited which results in a load explosion that occurs at the apex of the rocket trajectory. The launch apparatus can be used as a hand held device but it also has features that allow it to be used in a preferred stationary mount configuration.

In one embodiment, the launcher is mounted in a stationary position where the launcher barrel is aligned at an approximate 60 degree incline angle with the ground. Here, the bottle rocket powder-tube front end of the bottle rocket is partially inserted into the breech valve body opening. The breech valve may have a smooth surfaced cylindrical shaped valve opening where the opening diameter is approximately equal to the inside diameter of the launcher barrel. Both the breech valve opening and the barrel bore are in axial alignment to provide a near-continuous, smooth cylindrical bore that extends from the entrance of the breech valve up into the launcher barrel. Even though smooth, the launcher may require at least some modest static coefficient of friction on the internal surface to have any rocket resist backsliding within the chamber after insertion, especially when a lit rocket is inserted into the end breech loading structure described herein. This continuous smooth surface allows unimpeded insertion of the bottle rocket into the depths of the barrel chamber. The launcher barrel with the end load breech system may have controlled friction properties at at least the lower end of the chamber to assure that an inserted rocket will not quickly slide back to the breech opening when thrust inside. The front portion of the bottle rocket may be positioned so that the rocket fuse is partially or fully exposed from the confines of the interior of the valve body. A slot for the fuse may be provided, and although this would reduce some of the expelling forces, the power loss would not be so significant as to prevent launch of the rocket. In this manner, an unlit rocket could be inserted into the launcher with a fuse exposed, and then the fuse could be lit, without having to close a breach or other opening after a fuse has been lit. Because of this partial insertion of the bottle rocket into the launcher body, a large portion of the rocket stick extends outside of the valve body. Immediately after lighting the bottle rocket fuse, the operator grasps the bottle rocket stick and inserts the forward portion of the bottle rocket into the valve opening and upward into the barrel chamber. Then the operator hits the end of the rocket stick with one hand in a direction along the axis of the stick to dynamically propel the complete bottle rocket into the launcher barrel chamber far enough to assure that the trailing base end of the stick arrives at a location within the barrel that is past the valve shut-off component. The bottle rocket tends to cling to the inside surface of the barrel due to gravity acting on the rocket to frictionally secure the rocket from sliding back down the barrel after the rocket stops its dynamic insertion travel. The valve is then quickly closed using the operator's same hand that was used in the rocket insertion event as this hand is already positioned close to the valve lever. Closing the valve seals off the breech end of the launcher barrel. The bottle rocket having a burning fuse is now positioned within the confines of the launcher barrel chamber. This rocket insertion action takes place immediately after lighting the rocket fuse to assure that the rocket is inserted and the valve is closed before the rocket tube powder is first ignited. The muzzle end of the launcher barrel remains open at all times. When the bottle rocket powder is ignited by the burning fuse the burning exhaust gases thrusts the bottle rocket along the length of the barrel past the muzzle and into the sky in the trajectory direction that the launcher barrel is pointed. The exhaust gasses are all restricted to the valve-sealed interior confirms of the launch barrel tube, which protects the operator from the gases as the rocket travels up the length of the barrel. Exhaust gasses that initially are propelled from the rocket powder tube toward the breech valve body are turned in reverse direction at the sealed breech end of the barrel. These turned gasses then travel in the direction of motion of the rocket as it moves up and along the barrel toward the muzzle. Exhaust gases expelled by the rocket are effective in both providing direct rocket thrust and also in providing an extra drag-force boosts that accelerates the rocket to even greater speeds and greater heights. These extra rocket boost drag forces are generated by moving-gas passing by the rocket body as the gasses move toward the barrel muzzle. Here, the barrel-contained exhaust gases travel in the small annular space that is directly adjacent to the rocket body as the gasses move toward the barrel muzzle to escape the confines of the interior of the launcher barrel. The inside diameter of the bottle rocket is selected to be sufficiently larger than the equivalent diameter of the bottle rocket device to allow unrestrained insertion of the bottle rocket into the launcher barrel. A close fit between the bottle rocket body and the barrel interior wall increases the velocity of the valve-trapped burning powder gasses that travel in the small annular gap between the launcher barrel inside wall and the rocket body. These gasses drag the rocket body to a faster speed as they move past the rocket body when wall-gap spaces are smaller. A typical bottle rocket is approximately 0.5 inches in diameter at the rocket tube end and has a overall length of approximately 11 inches. A rocket launcher barrel would typically have a 0.75 inch inside diameter and a barrel length of 24 inches. Larger diameter and longer barrel length launchers can be used with larger sized bottle rockets. Tubular barrel lengths can be easily changed by the use of threaded couplings to screw-on another section of threaded pipe to the end of a threaded barrel.

In another, but less desirable embodiment, the launch tube may be used as a hand-held rocket launching device rather than the launcher being supported as a stationary device on the surface of the ground. If the launch tube is held by hand during launch, it is necessary that the tube axis be held away from the operators body to prevent the rocket or hot rocket exhaust gases and burning powder debris from being directed at the operator's body, particularly at the operator's eyes. The burning rocket exhaust typically only travels a short distance backward from the moving rocket so there is a minimal problem with rockets that have cleared the end of a launcher having a long barrel. However, even with a long barrel that confines the exhaust products during the first and most dangerous stage of the launch there is yet a possibility of rearward traveling debris moving from the muzzle back along the exterior surface of the barrel and contacting an operator after the moving rocket clears the end of the launcher barrel muzzle.

Adjustable legs can be used to support the rocket launcher. It is preferred to us two adjacent legs on the muzzle and a single leg on the breech to create a very stable three-point launcher support system. The legs can position the breech valve end of the launcher some minimum distance above the ground to assure sufficient room is present for the easy loading of a long stick-type bottle rocket into the breech valve without disturbing the orientation or stability of the launcher apparatus. The height of the breech end of the launcher can be adjusted by positioning the breech leg so that the base of the bottle rocket stick rests on the ground when the powder tube end of the rocket is partially inserted into the breech valve in a manner that the rocket fuse is exposed to the operator. Here, it is not necessary for the operator to hold the rocket stick in position relative to the breech valve at the same time that he or she is lighting the fuse. Legs attached to the muzzle end of the barrel support the axis of the barrel at an incline with the ground. The incline angle can range from a shallow angle of 30 degrees up to a vertical 90 degrees. Initially, the launcher incline angle can be set in position by adjusting the launcher support leg positions. Then the legs can be readjusted to change the trajectory of the launched rockets for subsequent launches. These legs allow the launcher to be set up at the desired angle even on a ground surface that is quite irregular and non-level due to rocks or other factors. When the launcher is not in use it can be prepared for travel or storage by pivoting the legs parallel to the launcher barrel. Likewise the breech valve lever can be positioned parallel to the launcher barrel with the end of the lever pointing toward or away from the muzzle. The folded-up launcher is very light-weight, durable and has a very slim profile.

The breech valve can be opened after a miss-fire launch attempt to clear out the defective rocket by simply shaking or impacting the barrel to cause the rocket to drop out of the launcher. A small-diameter cleaning rod can also be inserted into the breech valve end or into the muzzle end of the barrel to dislodge the defective rocket from the barrel. If a defective rocket does experience an undesirable firing event during the rod clearing or impact dislodging process, the rocket will simply be held in place by the rod, or, the rocket will leave the exit end of the barrel. In either case, the operator would not be endangered by the miss-fire if care were exercised in the rocket-clearing process.

In another launcher embodiment, rockets can be inserted into the launcher barrel at a barrel side-door that is located at the side of the barrel just above the valve. The barrel end breech valve would be retained on this launcher configuration to provide a safe defective rocket clean-out capability.

In yet another launcher embodiment, a stationary launcher having a near vertical position can be loaded with a bottle rocket from the muzzle end of the launcher barrel muzzle. A bottle rocket can be positioned with the bottle rocket stick inserted into the launcher barrel tube where the bottle rocket powder tube rests on the edge of the barrel muzzle to prevent the rocket from sliding down into the depths of the barrel before the fuse is lighted. The flexible rocket fuse that originates at the base of the rocket powder tube can be routed over the lip of the muzzle to a position where the free end of the fuse is exposed for access by the operator. At launch, the operator can light the fuse and simply nudge the exposed rocket body to dislodge it from the muzzle support whereby the rocket will immediately fall into the depths of the barrel. After the rocket reaches the bottom of the barrel the burning fuse will light the rocket powder and the rocket will be propelled out of the rocket launch tube. A group of small diameter multiple rockets can be partially inserted into the muzzle end of a large diameter launcher barrel, the fuses lit and the rockets then dropped into the depths of the barrel where they will fire as a group or in the sequence that they were lit. Twisting them together before lighting can mutually join multiple fuses into a single master fuse when using multiple muzzle-loaded rockets at the same time. By having a single lighting event for all the rockets provide assurance assure that sufficient time is allocated to the lighting procedure before the rockets are dropped into the barrel.

The rocket launcher article principal components are a barrel and a breech valve. The breech valve allows a fuse-lit bottle rocket to be quickly inserted into a launcher barrel and the valve closed before the rocket is ignited. The launcher has a launcher breech end and a barrel muzzle end where the bottle rocket is inserted into the breech end and the rocket is propelled out of the muzzle end. The barrel is a lightweight and rigid tube, preferably fabricated from a polymer material to resist corrosion and for ease of cleaning. Plated or corrosion resistant metal materials may also be used for the barrel tube. The barrel has a barrel chamber, a barrel length, a barrel inside diameter, a barrel outside diameter and a barrel inside diameter surface where the surface has a cylindrical shape where the barrel inside diameter is at least 60% of the barrel outside diameter. Also, the barrel has a barrel axis that extends from the launcher breech end to the barrel muzzle end where the barrel axis is concentric with the barrel inside diameter. The breech valve is structurally attached to the barrel at the launcher beech end of the barrel and the breech valve has a valve body that has an exterior surface. In addition, the breech valve has a rotary member, which can be rotated over angles that vary from 0 to at least 90 degrees. The rotary valve member has a smoothbore circular through-hole that is machined or otherwise formed through the diameter of the rotary member. Breech valves may have different types of rotary members including cylindrical or spherical type ball members. Breech valves may also include gate, shuttle or slide valves that have either pivoting or slide actions. It is preferred that there are low friction forces present in rotating the valve rotary member to provide ease of opening or closing a valve. Also, the rotary member has an attached rotary member lever that has a lever axis that extends along the length of the lever. The lever allows the rotary member to be manually rotated over the full allowed rotary member angle where the rotary member angle position of the lever, as seen visually relative to the valve body exterior surface, indicates the angle at which the rotary member is positioned relative to the barrel axis. It is easy to see or verify that the valve is fully open or fully closed by simply observing the position of the extended valve lever, the same method that is used to visually determine if a home furnace natural gas valve is open or closed. A cylindrical shape is preferred, in which case the axis of the through-hole is perpendicular to the axis of the axis of the cylinder. The rotary member has two fixed rotational stop positions, which are separated by 90 degrees. At one extreme position, the valve is full open and the lever is aligned with the barrel axis to indicate this open position. At the second extreme position the valve is full closed where the rotary member lever axis is positioned perpendicular to the barrel axis to indicate the full closed position. In the full open position, the valve member through-hole axis is aligned congruent with the barrel axis to provide a continuous cylindrical-shape opening that extends from the external surface of the breech valve through the full length of the inside diameter of the barrel. When in the full closed position, the rotary member seals the barrel breech valve to prevent direct in-line communication between the exterior of breech valve and the barrel chamber. The valve member through-hole diameter is at least 50% of the barrel inside diameter. The smooth cylindrical shape of the valve through hole and also the cylindrical shape of the barrel allows a bottle rocket to be fully inserted up into the barrel chamber with little force when the valve is full open. In the event that the trailing end of the bottle rocket stick is not fully inserted to a position within the barrel chamber that is past the valve member after the fuse is lit, there is a possibility that the valve member clamps onto the end of the stick when the valve lever is rotated toward the closed position, which would prevent the valve from being successfully rotated into a valve full closed position. In this case there would be a small gap opening between the barrel chamber and the exterior surface of the valve body which would allow some of the burning rocket powder gases to escape from the breech end of the rocket launcher apparatus when the rocket contained within the barrel chamber becomes ignited by the burning fuse. Because the leakage gap is small, only a fraction of the total quantity of the gases generated by the rocket would escape and these gases would be directed at the ground in a harmless fashion. The rocket would not be propelled from the barrel muzzle, as the rotating valve member would trap the rocket inside the barrel chamber. After the rocket had harmlessly fully burned it's powder and exploded within the barrel chamber, the rocket explosion would indicate to the operator that the rocket is in a harmless state. The force generated by the rocket explosion inside the launcher barrel would not damage the rocket barrel or breech valve as both the barrel and valve would selected to have sufficient strength to resist these forces. The valve could be opened and the expended bottle rocket carcass removed from the rocket launcher. If there is a question about the safety of the launcher that contains an unfired rocket or a rocket of unknown nature, water could be poured down the barrel prior to opening the valve to saturate the rocket body and snuff out or prevent any powder burning action before the rocket is removed from the barrel. Water could be easily cleared from the interior surface of the smoothbore launcher barrel and valve member through-hole prior to launching another bottle rocket. A sturdy mirror can be used to check the condition of the launcher or to verify that a rocket is not lodged in the barrel before it is used to launch a new rocket. When a mirror is used, it is easy to see through the full interior length of a launcher when the valve is open. With a mirror it is not necessary for the operator to look directly down the bore of the barrel, which could expose the operator's eye to potential damage from an undesirable rocket firing or explosive event.

FIG. 1 shows a side view of a bottle rocket launcher. A bottle rocket 34 having a rocket shaft stick 18 and a powder tube 14 that is attached parallel to and at one end of the stick 18 has a flammable ignition fuse 16. The bottle rocket 34 is shown in position to be loaded into the bottle rocket launcher 10, which has breech valve 24 that is structurally attached to the launcher barrel 4. Another bottle rocket 2 is shown in flight after having left the muzzle 36 end of the launcher 10. Two legs 28, 30 are shown in a launcher support position where they support the muzzle 36 end of the barrel 4 at an incline angle 38 that is measured between the surface of the ground 32 and the axis (not shown) of the length of the barrel. The two legs 28, 30 are both attached to the launcher barrel 4 by the use of fasteners 20 and both have pivot points 42 and barrel clamps 6, 8 where the clamps can be individually slid to a desirable position along the barrel to provide the desired launcher incline angle 38 and to provide a stabilizing support angle as seen facing the barrel muzzle 36 (not shown) between the two legs 28, 30. The two independent barrel support legs 28, 30 can pivot relative to the axis of the barrel 4 where the pivot action occurs about the fastener 20 locations. The leg 30 is not separately shown as it is positioned in the drawing figure directly behind the leg 28. Both of the legs 28, 30 are positioned rotationally about the barrel 4 axis and along the barrel 4 length by the use of the collars 6, 8 which can both be independently rotated and slid along the barrel 4 length. Looking horizontally at the barrel muzzle 4 of a launcher 10 the two legs 28, 30 would have an included angle between them of at least 30 degrees to provide lateral stability to the launcher barrel 4. When the launcher 10 is not in use, the two barrel legs 28, 30 can be positioned along both sides of the barrel 4 to minimize the launcher size for storage. The breech leg 26 is attached to the breech valve 24 and also pivots about the fastener 40 location to allow the leg 26 to support the breech valve 24 some distance above the ground 32 to allow the bottle rocket 34 to be loaded into the breech valve rotary member 22 that has a through-hole (not shown). The rotary member 22 has a valve lever 12, which is shown in a position where a lever axis that extends along the length of the lever 12 is perpendicular to an axis that extends along the length of the barrel 4 to indicate that the valve 24 is closed. The bottle rocket 34 has a rocket stick 18 to which the rocket powder tube 14 is attached and where the rocket fuse 16 is attached to the rocket tube 14.

Figure 2:
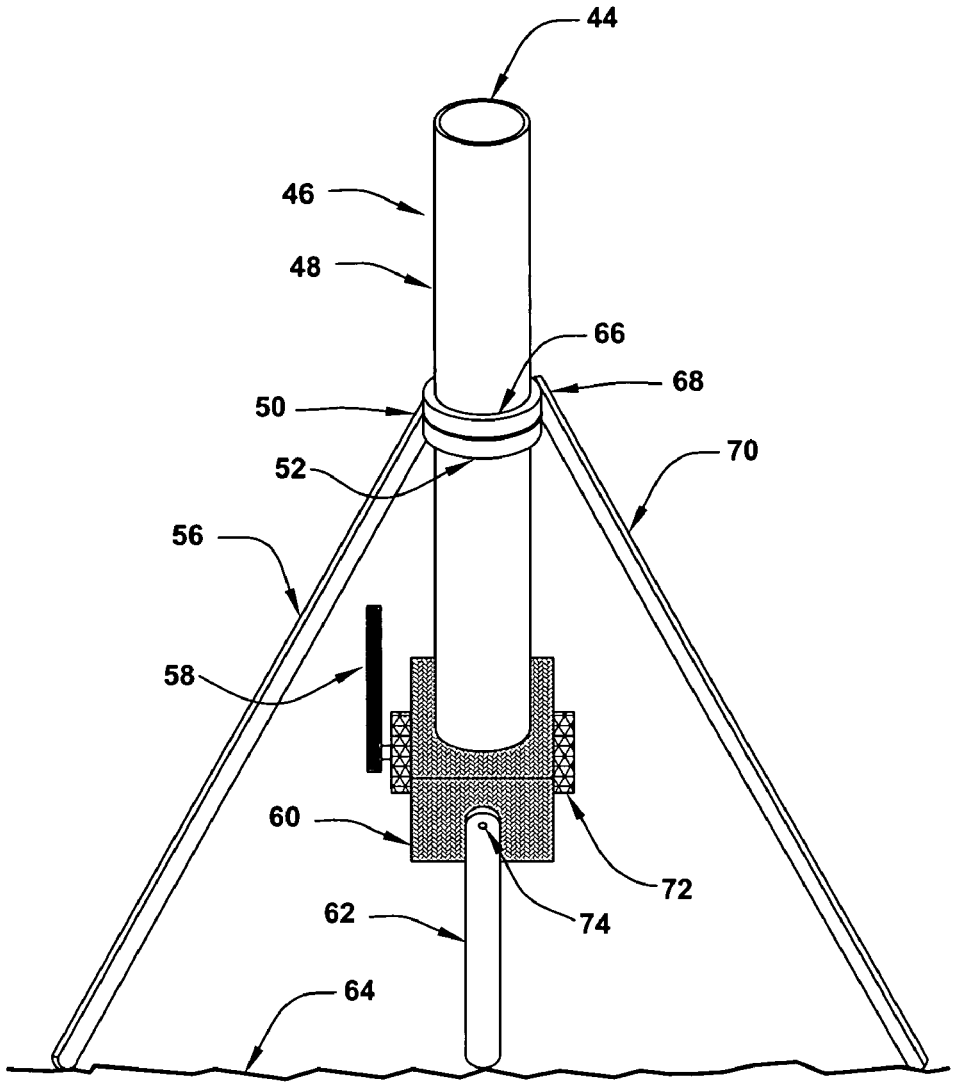
FIG. 2 shows a front view of a bottle rocket launcher.
Figure 3:
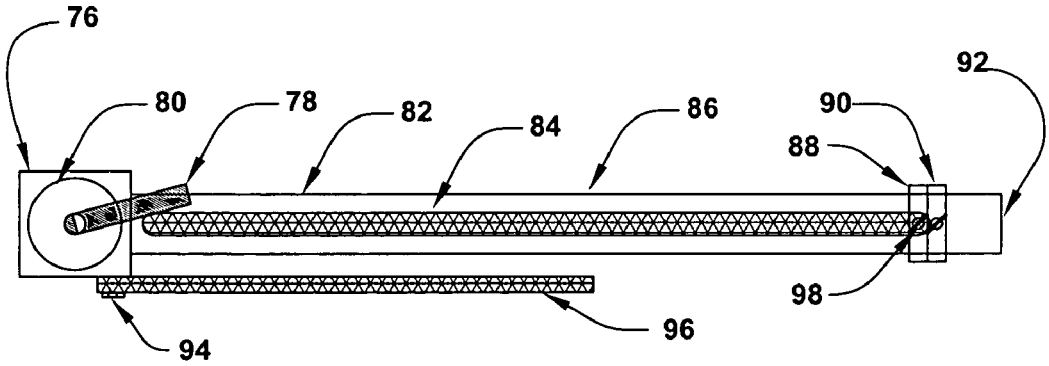
FIG. 3 shows a side view of a bottle rocket launcher that has the supporting legs folded into a storage configuration.
Figure 4:
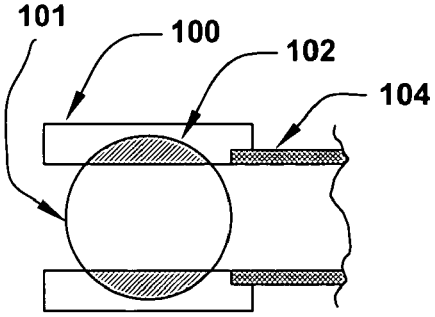
FIG. 4 shows a cross section view of a breech valve in a valve full-open position.

FIG. 2 shows a front view of a bottle rocket launcher 48 that has a barrel 46 and a muzzle 44 where the launcher 48 is supported on a ground surface 64 by two front support legs 56, 70 and a single breech leg 62 that is attached to a breech valve 60 by a pivot type fastener 74. The two front legs 56, 70 are independently attached to two ring-type collars 52, 66 by collar pivot type fasteners that are located at pivot points 50, 68 where the collars can both be independently rotated on the barrel 46 and slide along the barrel 46 which allows the launcher barrel axis to be positioned at a desired angle relative to the ground. The three legs 62, 56, and 70 act as a three-point launcher 48 support that provide stability to the launcher device. The breech valve 60 has a rotating cylindrical shaped valve member 72 that is rotated by a valve lever 58. The breech valve is shown as a cylindrical valve but it could also be a spherical valve or another type of valve. Also, the launcher 48 barrel 46 is shown as a cylindrical hollow tube barrel but the barrel could have a rectangular inside or exterior surface where rectangular shaped collars 52 and 66. FIG. 3 shows a side view of a bottle rocket launcher that has the supporting legs folded into a storage position along side the launcher barrel. The bottle rocket launcher 82 has a barrel 86 and leg collars 88, 90, which support barrel legs 84 that are mounted with pivot fastener pins 98, and where the backside barrel leg is not shown. The legs 84 are shown folded into a position where they lay parallel to and directly adjacent to the barrel axis that is parallel along the length of the barrel 86. The breech leg 96 is attached to the breech valve 76 by a pivot fastener 94 and the breech leg is shown pivoted parallel to the axis of the barrel 86. A breech valve 76 rotary member 80 has a valve lever 78 that is shown rotated into a position that is nearly parallel to the barrel 86 axis. The barrel 86 has a barrel muzzle 92. FIG. 4 shows a cross section view of a bottle rocket launcher breech valve and a portion of a launcher barrel where the breech vale is in a valve full open position. The breech valve 100 contains a cylindrical or spherical valve rotary member 102 that has a through-hole 101 which is in open passage alignment with the open inside diameter of the inside bore of a launcher barrel 104.

Figure 5:
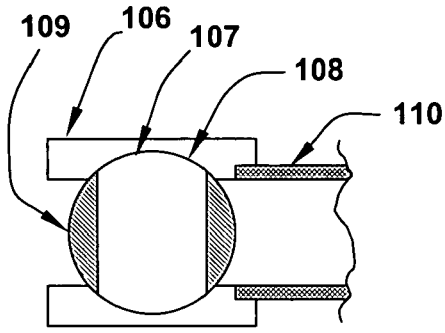
FIG. 5 shows a cross section view of a breech valve in a valve full-closed position.
Figure 6:
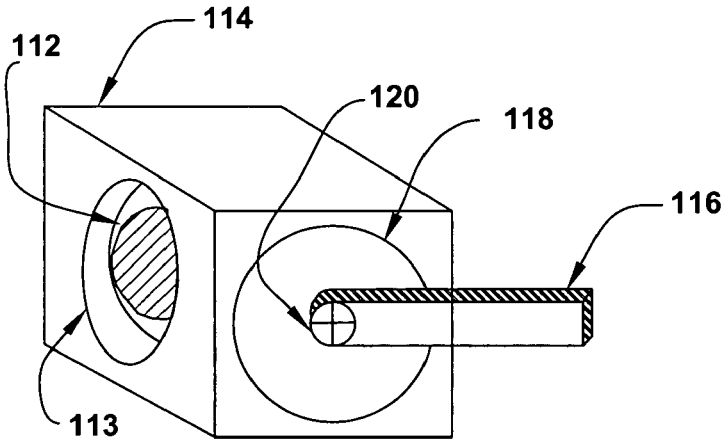
FIG. 6 shows an isometric view of a bottle rocket launcher breech valve and valve lever.
Figure 7:
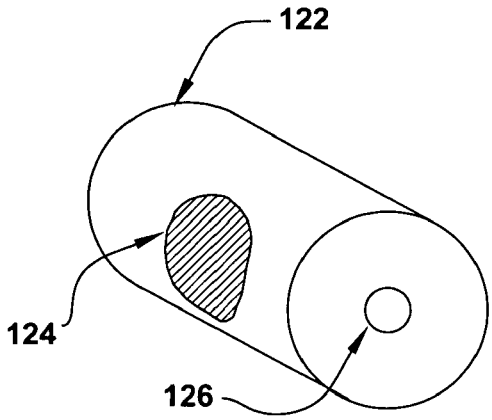
FIG. 7 shows an isometric view of a rocket launcher breech valve cylindrical rotary member.
Figure 8:
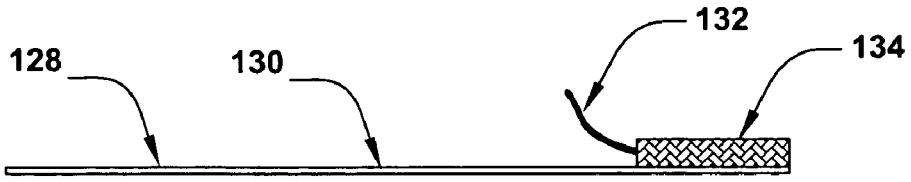
FIG. 8 shows a side view of a bottle rocket.
Figure 9:
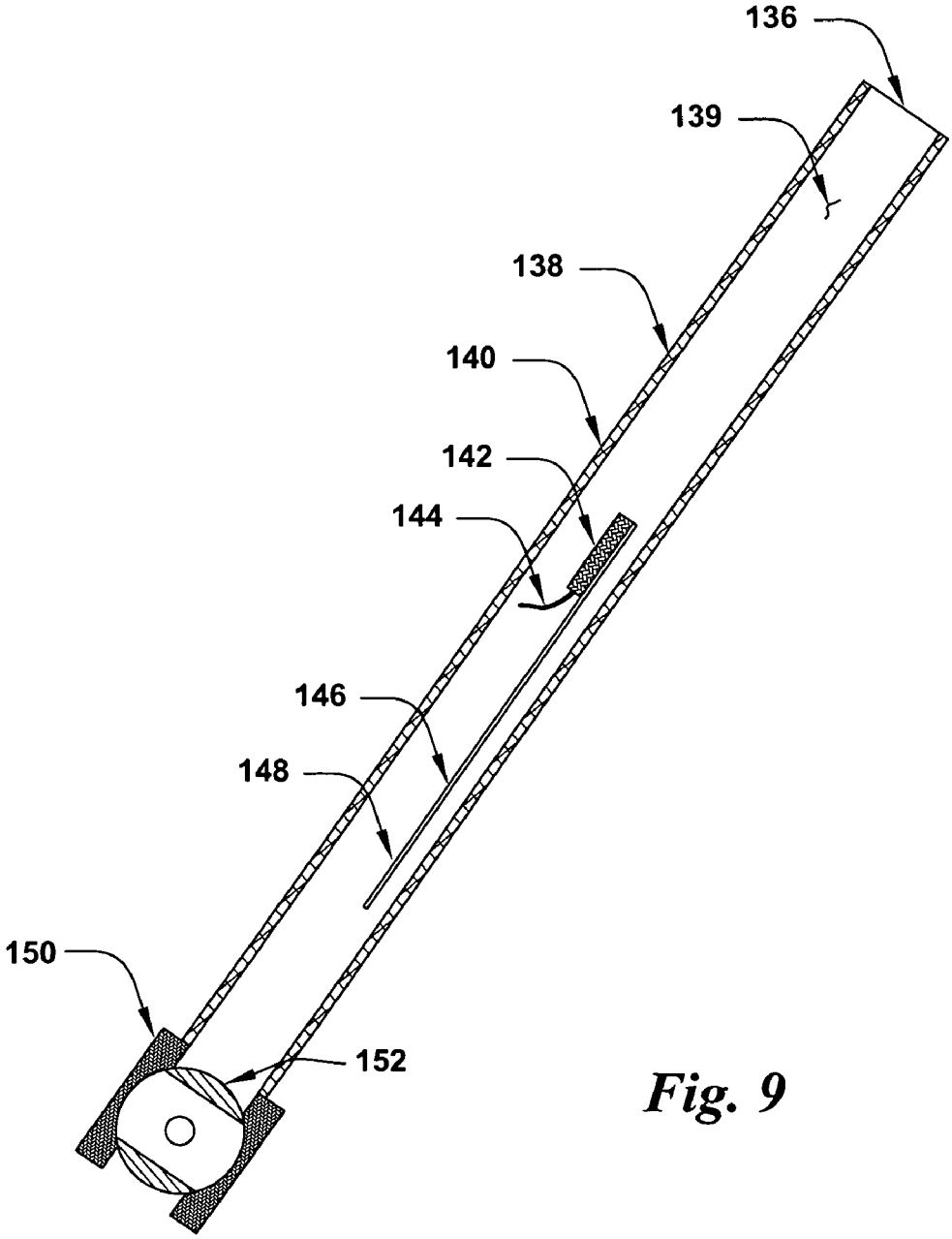
FIG. 9 shows a cross section view of a bottle rocket launcher containing a bottle rocket.

FIG. 5 shows a cross section view of a bottle rocket launcher breech valve and a portion of a launcher barrel where the breech vale is in a valve full closed position. The breech valve 106 contains a cylindrical or spherical valve rotary member 108 that has a through hole 107 which is in a closed passage alignment with the open inside diameter of the inside bore of a launcher barrel 110. The member barrier area 109 blocks line-of-sight communication between the outside environment at the exterior of the breech valve 106 and the open bore of the barrel 110. FIG. 6 shows an isometric view of a bottle rocket launcher breech valve and valve lever. The breech valve 114 has a rotary member 118 that has a open passageway through hole 112 where the valve lever 116 that is attached to the valve member 118 by the fastener 120 is shown in a valve 114 full-open position where the through hole 112 is aligned with the valve 114 port hole 113 opening. FIG. 7 shows an isometric view of a rocket launcher breech valve cylindrical rotary member. The breech valve cylindrical rotary member 122 has a through hole 124 and the member 122 has a cylinder-center mounting hole that is used to mount a valve member lever (not shown). FIG. 8 shows a side view of a bottle rocket. The bottle rocket 128 has a thin support stick 130 that supports a powder tube 134 that is filled with a flammable powder (not shown) where the powder tube 134 has an attached fuse 132. The powder tube 134 is attached to the stick 130 where the tube 134 is positioned at one end of the stick and the axis of the cylindrical powder tube 134 is immediately adjacent to the stick 130 where the axis of the powder tube 134 is parallel to the axis of the stick 130. FIG. 9 shows a cross section view of a bottle rocket launcher containing a bottle rocket. The bottle rocket launcher 138 has a launcher barrel 140 that has a barrel muzzle 136. The launcher barrel 140 has an attached breech valve 150 that has a valve rotary member 152 that is shown in a full closed position where line-of-sight communication between the exterior surface of the valve 150 and the inside surface of the hollow barrel 140 is blocked. A bottle rocket 146 having a bottle rocket stick 148, a powder tube 142 and a fuse 144 is shown in a position partway up the inside chamber 139 of the barrel 140 that is shown at an inclined angle with the ground, not shown.

The valve construction (both in materials and shape) optionally provides sufficient hardness and sharpness as to be able to cut through or at least snap off (by crushing or shearing) a bottle rocket end stick, if it should happen to engage the valve through improper insertion. The lever should be long enough and strong enough to enable application of sufficient forces to accomplish this removal of any entrapped stick portion.

Figure 10:
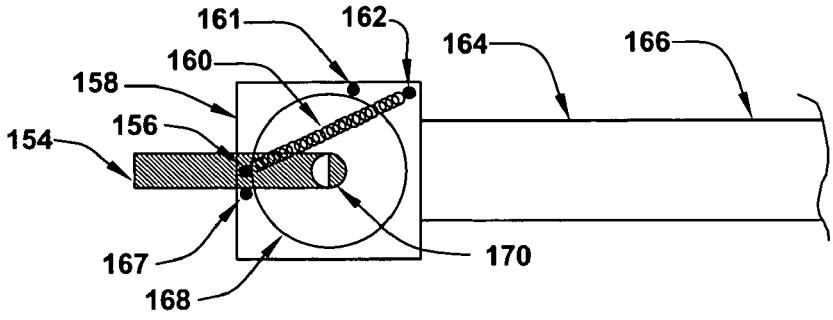
FIG. 10 shows a side view of a tension spring activated bottle rocket launcher valve in the valve open position.
Figure 11:
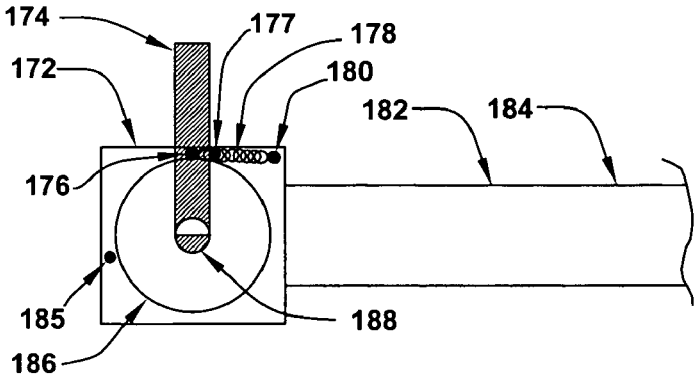
FIG. 11 shows a side view of a tension spring activated bottle rocket launcher valve in the valve-closed position.

FIG. 10 shows a side view of a tension spring activated bottle rocket launcher valve in the valve-open position. The bottle rocket launcher 164 has a launcher hollow barrel 166 that is attached to a launcher valve 158 that has a cylindrical valve rotary member 168, which has a valve member cylinder center 170. The rotary member 168 has a valve actuator lever 154 that is attached to the member at the member center 170. A tension spring 160 that is attached to the lever 154 by a pin 156 and also is attached to the valve 158 body by a pin 162 applies a force on the lever 154 that acts to close the valve internal passageway (not shown). The valve 158 is shown in a full open position as indicated by the lever 154 at a position that is parallel with the length of the barrel 166. It is necessary for the lever 154 to be manually held in this open position to allow a bottle rocket to be inserted into the launcher barrel 166 inside chamber (not shown) through the valve 158 passageway opening. The full-open position is established by moving the lever 154 where the side of the lever 154 contacts a pin 167 that is attached to the valve body 158. When the operator releases the lever 154, the valve 158 is automatically closed in its full closed position by the spring 160 when the side of the lever 154 contacts a pin 161 that is attached to the valve 158 body. FIG. 11 shows a side view of a tension spring activated bottle rocket launcher valve in the valve-closed position. The bottle rocket launcher 182 has a launcher hollow barrel 184 that is attached to a launcher valve 172 that has a cylindrical valve rotary member 186, which has a valve member cylinder center 188. The rotary member 186 has a valve actuator lever 174 that is attached to the member at the member center 188. A tension spring 178 that is attached to the lever 174 by a pin 176 and also is attached to the valve 172 body by a pin 180 applies a force on the lever 174 that acts to close the valve internal passageway (not shown). The valve 172 is shown in a full closed position as indicated by the lever 174 at a position that is perpendicular to the length of the barrel 184. It is not necessary for the lever 174 to be manually held in this closed position as the spring force holds the valve closed. When the operator releases the lever 174 from the full open or partially open position, the valve 158 is automatically closed by the spring 160. The full closed position is established by moving the lever 174 where the side of the lever 174 contacts a pin 177 that is attached to the valve 172 body. When the operator manually rotates the lever 174, the valve 172 is automatically positioned in its full open position by the spring 178 when the side of the lever 174 contacts a pin 185 that is attached to the valve 172 body.

Figure 12:
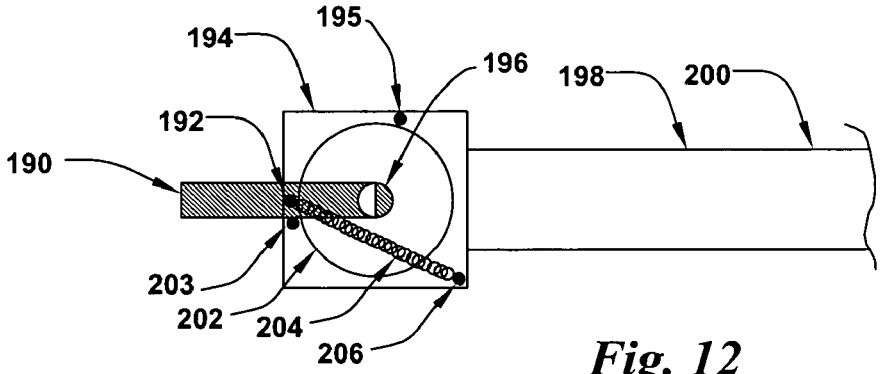
FIG. 12 shows a side view of an over-center spring activated bottle rocket launcher valve in the valve open position.
Figure 13:
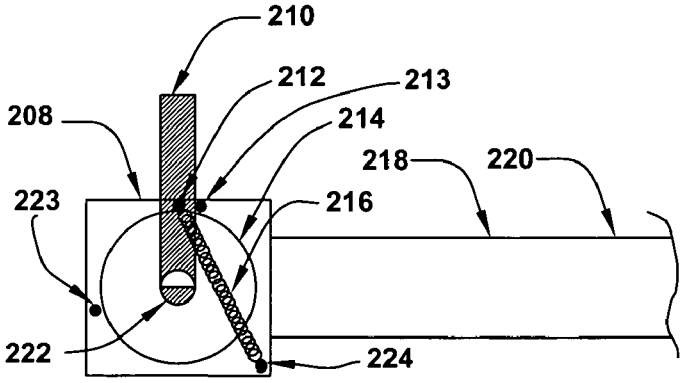
FIG. 13 shows a side view of an over-center spring activated bottle rocket launcher valve in the valve-closed position.

FIG. 12 shows a side view of an over-center spring activated bottle rocket launcher valve in the valve open position. The bottle rocket launcher 198 has a launcher hollow barrel 200 that is attached to a launcher valve 194 that has a cylindrical valve rotary member 202, which has a valve member cylinder center 196. The rotary member 202 has a valve actuator lever 190 that is attached to the member 202 at the member center 196. A over-center tension spring 204, that is attached to the lever 190 by a pin 192 and also is attached to the valve 194 body by a pin 206, applies a force on the lever 190 that acts to close the valve internal passageway (not shown). The valve 194 is shown in a full-open position as indicated by the lever 194 at a position that is parallel with the length of the barrel 200. It is not necessary for the lever 190 to be manually held in this open position to allow a bottle rocket (not shown) to be inserted into the launcher barrel 200 inside chamber (not shown) through the valve 194 passageway opening as the spring 204 has a spring 204 centerline that is offset from the member cylinder center 196. This spring 204 off set occurs as the centerline of the spring 204 travels over the center located at the cylinder center 196 when the lever 190 is manually moved from the valve 194 full closed position to the full open position. When the operator releases the lever 190 after the spring 204 centerline has traveled over the center 196, the valve 194 is automatically opened and held open by the spring 204 even when the operators hand (not shown) is removed from the valve lever 190 as the lever 190 comes to rest on a lever stop pin 203. To toggle the lever 190 into a valve 194 full-open or full-closed position it is only necessary for the operator to bump the lever 190 to a position where the spring 204 centerline crosses the center 196. The spring 204 maintains the new valve 194 open or closed position until the valve lever 190 is manually bumped or moved to the opposite side of the valve 194 far enough that the spring 204 centerline crosses the member center 196 whereby the lever 190 comes to rest either on the lever stop pin 195 or on the stop pin 203. FIG. 13 shows a side view of an over-center spring activated bottle rocket launcher valve in the valve-closed position. The bottle rocket launcher 218 has a launcher hollow barrel 220 that is attached to a launcher valve 208 that has a cylindrical valve rotary member 214, which has a valve member cylinder center 222. The rotary member 214 has a valve actuator lever 210 that is attached to the member 214 at the member center 222. A over-center tension spring 216, that is attached to the lever 210 by a pin 212 and also is attached to the valve 208 body by a pin 224, applies a force on the lever 210 that acts to close the valve internal passageway (not shown). The valve 208 is shown in a full-closed position as indicated by the lever 210 at a position that is perpendicular to the length of the barrel 220. It is not necessary for the lever 210 to be manually held in this closed position as the spring 216 has a spring 216 centerline that is offset from the member cylinder center 222. This spring 216 off set occurs as the centerline of the spring 216 travels over the center located at the cylinder center 222 when the lever 210 is manually moved from the valve 208 full-open position to the full-closed position. When the operator releases the lever 210 after the spring 216 centerline has traveled over the center 222, the valve 208 is automatically closed and held closed by the spring 216 even when the operators hand (not shown) is removed from the valve lever 210 as the lever 210 comes to rest on a lever stop pin 213. To toggle the valve lever 210 into a valve 208 full-open or full-closed position it is only necessary for the operator to bump the lever 210 to a position where the spring 216 centerline crosses the center 222. The spring 216 maintains the new valve 208 open or closed position until the valve lever 210 is manually bumped or moved to the opposite side of the valve 208 far enough that the spring 216 centerline crosses the member center 222 whereby the lever 210 comes to rest either on the lever stop pin 213 or on the stop pin 223.

Figure 14:
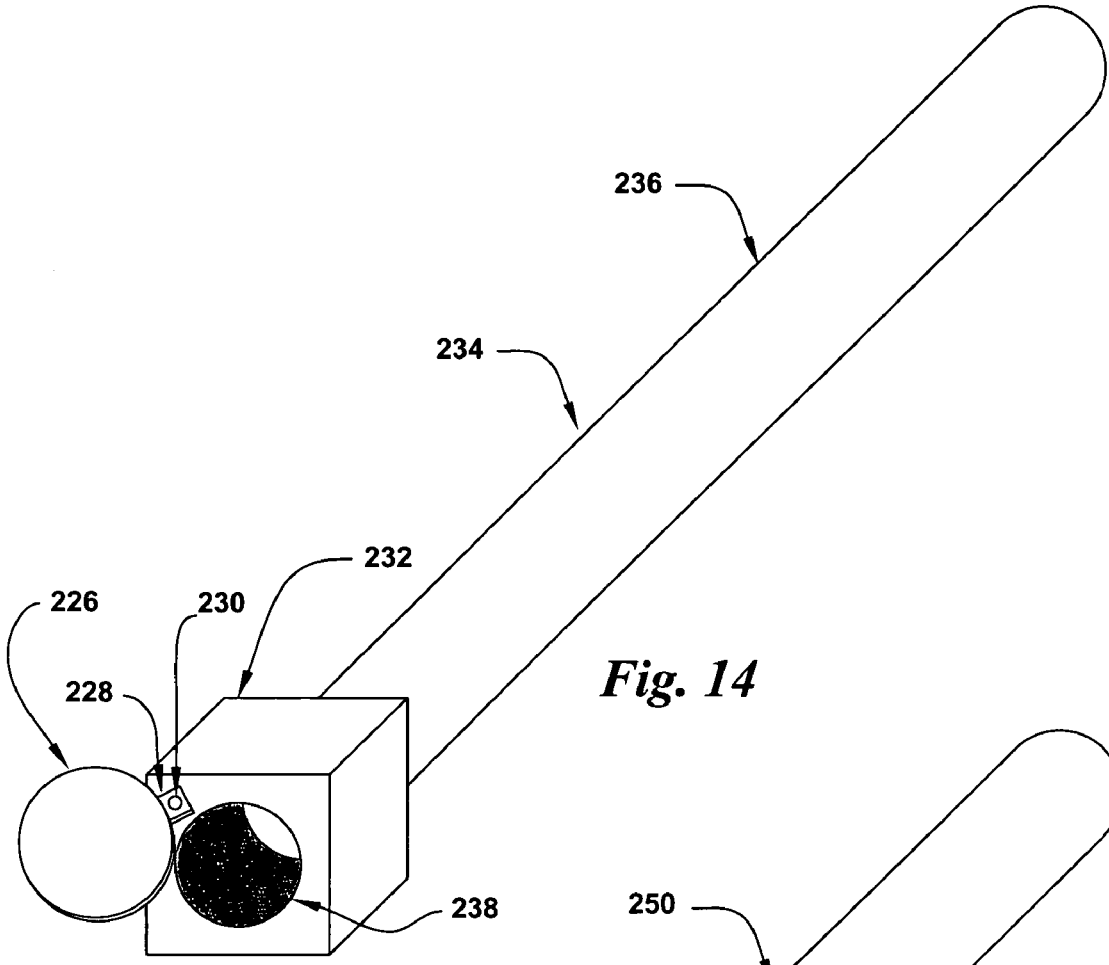
FIG. 14 shows a side view of a bottle rocket launcher having a flat pivot door valve with the door in a valve-open position.
Figure 15:
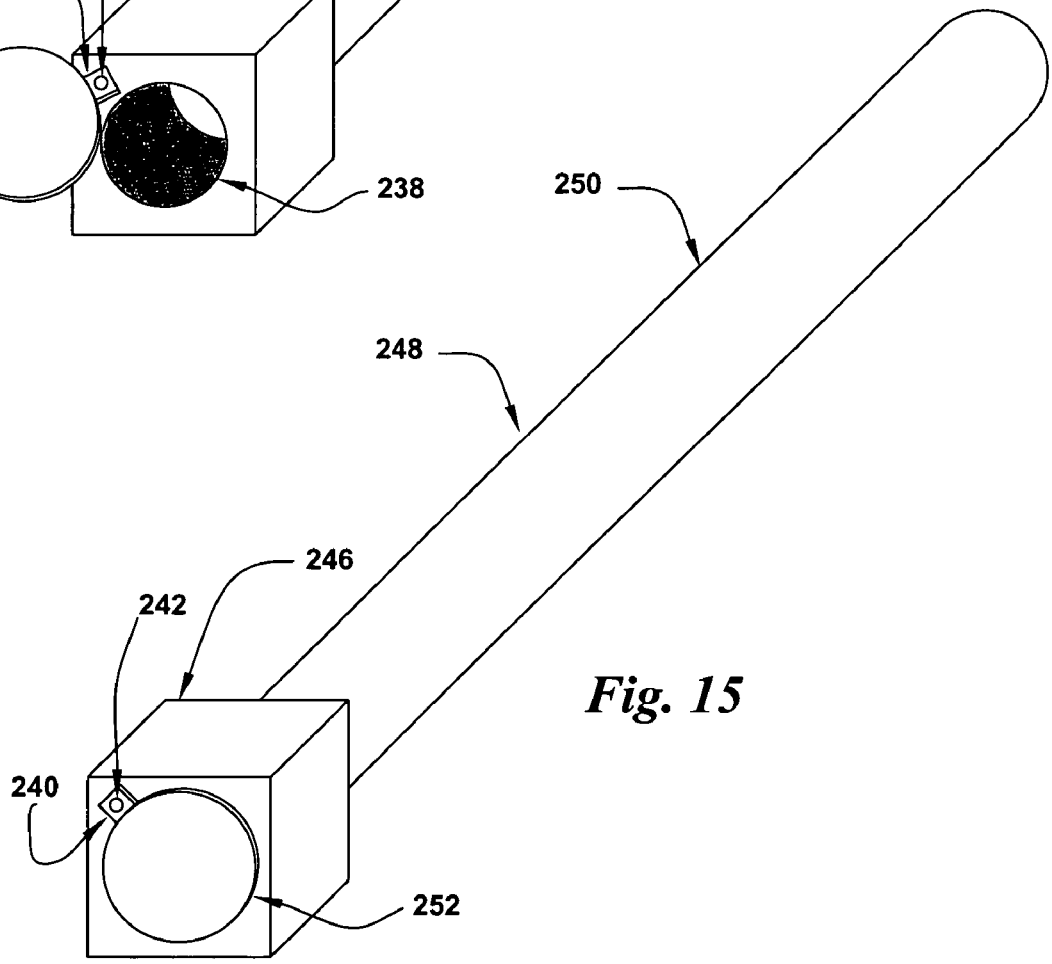
FIG. 15 shows a side view of a bottle rocket launcher having a flat pivot door valve with the door in a valve-closed position.

FIG. 14 shows a side view of a bottle rocket launcher having a flat pivot door valve with the door in a valve-open position. The bottle rocket launcher 234 has a launcher barrel 236 that is attached to a breech valve 232 where the breech valve 232 has a valve opening 238 through which a bottle rocket (not shown) can be inserted. The valve 232 has a pivot door 226, shown in a valve 232 open position that has a door tab 228 which is pivoted about the pivot point 230. The valve is a very simple device and is easy to construct but it is not durable and it is difficult to seal the valve against rocket (not shown) exhaust with this type of pivot door 226. FIG. 15 shows a side view of a bottle rocket launcher having a flat pivot door valve with the door in a valve-closed position. The bottle rocket launcher 248 has a launcher barrel 250 that is attached to a breech valve 246 where the breech valve 246 has a pivot door 252, shown in a valve 246 closed position. The door 252 has a door tab 240, which is pivoted about the pivot point 242. The door 252 is supported on one side only by a cantilever beam type thin tab 240 which is a structurally unable to maintain a flat seal of the door 252 with the valve 246 body when the internal surface of the door 252 is subjected to exhaust pressure generated by an internal exploding rocket, which is why this design configuration is not preferred.

Figure 16:
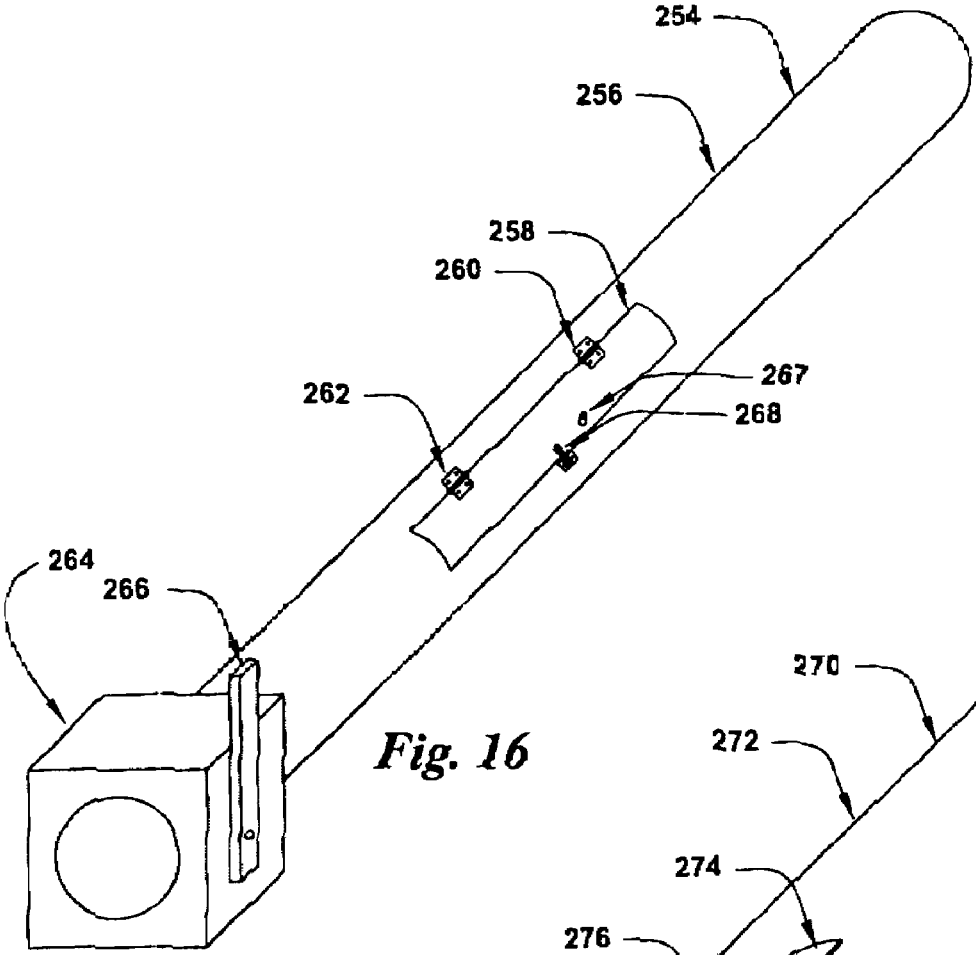
FIG. 16 shows a rocket launcher system with a side breach opening.

FIG. 16 shows an isometric view of a bottle rocket launcher with a closed side-barrel door. Bottle rockets (not shown) are loaded into the launcher barrel chamber through the side door either prior to the rocket flammable fuse being lighted or loaded after the fuse is lighted. The bottle rocket launcher 256 has a launcher barrel 254 that is attached to a launcher breech valve 264 that is opened or closed with a valve lever 266. The launcher 256 has a barrel door 258 that is attached to the barrel 254 by pivot hinges 260 and 262 where the door 258 is shown in a door-closed position. The door 258 is held in the closed position by a pivot-bar swivel latch 268 that holds the door 258 in a closed position where the outer cylindrical surface of the door 258 is flush with the outer cylindrical surface of the barrel 258. The barrel 254, the breech valve 264, the door 258, the hinges 260, 262 and the swivel latch 268 have sufficient structural strength to resist the explosive forces generated by a rockets that explode within the barrel chamber.

Figure 17:
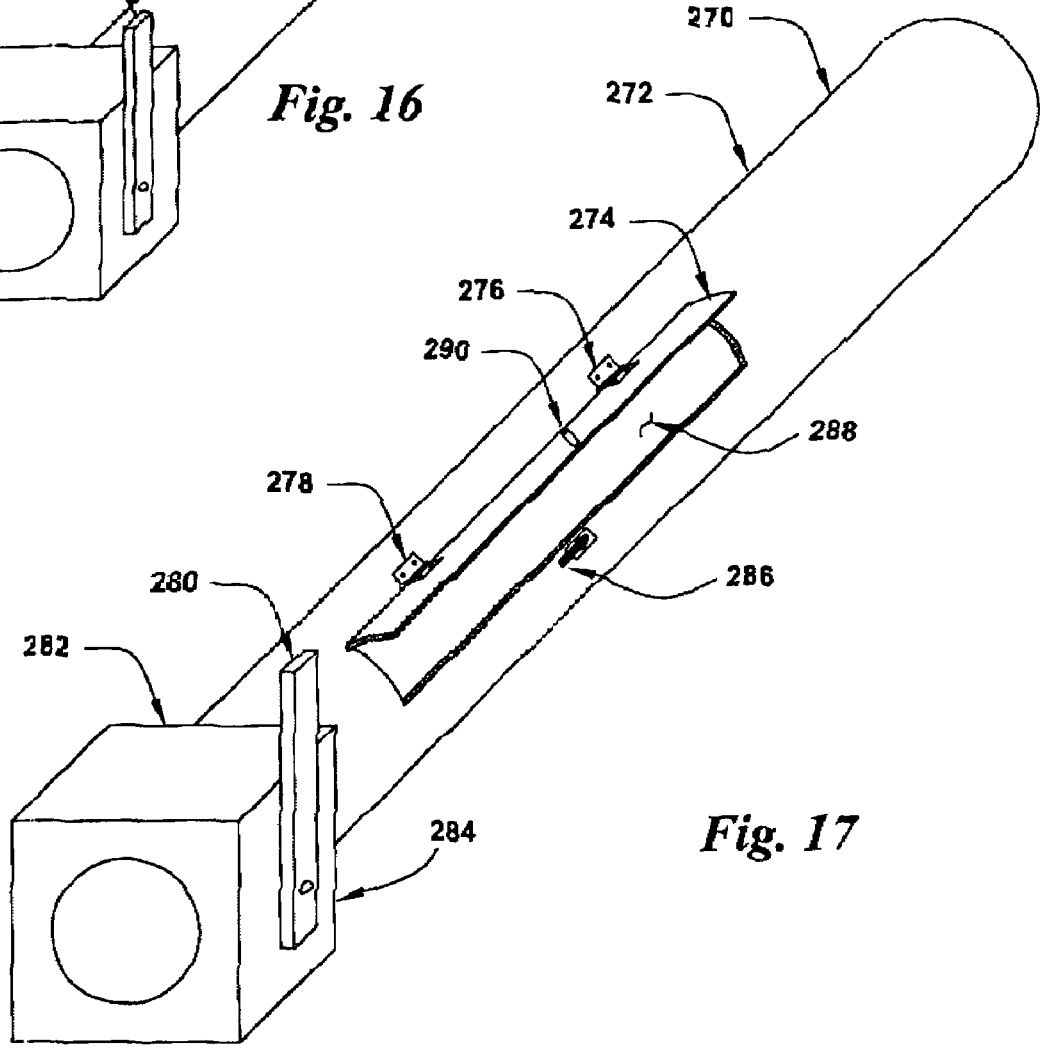
FIG. 17 shows a rocket launcher system with an opened side breach opening

FIG. 17 shows an isometric view of a bottle rocket launcher with an open side-barrel door. Bottle rockets (not shown) are loaded into the launcher barrel chamber 288 through the side door 274 either prior to the rocket flammable fuse being lighted or loaded after the fuse is lighted. The bottle rocket launcher 272 has a launcher barrel 270 that is attached to a launcher breech valve 282 that is opened or closed with a valve lever 280. The launcher 272 has a barrel door 274 that is attached to the barrel 270 by pivot hinges 276 and 278. The door 274 is shown here in a door-open position. A pivot-bar swivel latch 286 that holds the door 274 in a closed position is shown here with the pivot-bar swiveled into a position where the bar is parallel to the launcher barrel 270 to allow the door 274 to be opened by pulling or pushing on the door handle 290 for the insertion of a bottle rocket.

Certain, narrow embodiments of the disclosed bottle rocket launcher can be summarized by the following:

A bottle rocket launcher apparatus comprises a barrel and a breech valve, the launcher having a launcher breech end and a barrel muzzle end where the barrel is a hollow tube having an inside surface, a barrel chamber that extends the full inside surface of the barrel, and the barrel has a barrel length and a barrel axis that extends parallel to the length of the barrel. The breech valve is structurally attached to the barrel at the launcher beech end of the barrel where the breech valve has a valve body that has a exterior surface. The breech valve has a internal rotary member which has a cylindrical or spherical shape, the shape has a cylindrical or spherical diameter, and the rotary member is capable of being rotated over a angle that ranges at least from 0 to 90 degrees. The rotary member has a through-hole which extends through the diameter of the rotary member and the through-hole has a through-hole axis that is located at the center of the cross section area of the through-hole and extends along the length of the through hole. The rotary member provides line-of-sight communication from the exterior surface of the breech valve to the barrel chamber when the valve is in the valve full-open position that occurs when the through-hole axis is rotationally aligned parallel with the barrel axis. When the valve is at the full-open position, a continuous passageway opening extends from the external surface of the breech valve through the full length of the barrel chamber is provided. The rotary member provides that line-of-sight communication from the exterior surface of the breech valve to the barrel chamber is blocked when the valve is in the full-closed position where the through-hole axis is rotationally aligned perpendicular to the barrel axis. The rotary member has an attached rotary member lever, and the lever has a lever axis that extends along the length of the lever and the lever is manually rotated to open or close the valve. Rotation of the lever rotates the rotary member where the rotary member angle position of the lever, as viewed relative to the valve body exterior surface, indicates the angle that the rotary member is positioned relative to the barrel axis.

In addition, the rocket launcher can have a cylindrical shaped barrel, a barrel cylindrical inside surface shape, a barrel inside diameter and a barrel outside diameter where the barrel inside diameter is at least 60% of the barrel outside diameter. Further, the rocket launcher can have three support legs where the launcher breech end of the launcher is supported with a single breech leg and the launcher barrel end of the launcher is supported by two individual barrel legs where the three legs form a three-point launcher support that aligns the barrel axis at a launcher incline angle that ranges from 30 to 90 degrees, where the angle is measured from the ground surface at the launcher location and where, one end of each of the three legs is attached to the rocket launcher and the opposite end of each leg is capable of being manually moved in space relative to the rocket launcher apparatus. Also, all three of the rocket launcher support legs can be positioned with sufficient distance between each leg, where the distance is measured at the location where each leg contacts the ground, to provide stable structural support of the launcher. Additionally, the breech leg is attached to the launcher apparatus with a mounting fastener that allows the breech leg to be rotated or otherwise moved, manually into positions that allow the elevation of the breech end of the launcher to be adjusted relative to the ground surface at the launcher location. Further, the barrel legs can be attached to the launcher apparatus with mounting fasteners and barrel clamps that allow the legs to be moved manually into positions that allow the elevation of the muzzle end of the launcher to be adjusted relative to the ground surface at the launcher location to provide a desired launcher incline angle. In addition, the three support legs attached to the launcher apparatus can be attached to the launcher apparatus with the use of fasteners and clamps that allow all three legs to be rotated and moved into launcher storage positions wherein all three legs lay directly adjacent to and parallel to the launcher barrel. The rocket launcher can have a rotary member lever that has a return spring that allows the rotary member to be manually rotated to a desired rotary member angle where the valve passageway to the barrel chamber is opened but where the spring automatically returns the rotary member to a valve-closed position when manual force is removed from the lever. Also, the rotary member lever return spring can be an over-center spring that provides two extreme lever positions to the breech valve manually operated valve lever where at one extreme lever position the breech valve is at a full-open position and at the second extreme lever position the breech valve is at a full-closed position.

An alternative description of launchers taught herein might comprise a bottle rocket launcher apparatus comprising a barrel and a breech valve, the launcher having a launcher breech end and a barrel muzzle end. The barrel comprises a hollow tube having an inside surface, the barrel having a barrel chamber that compromises all of the inside surface of the barrel, the barrel having a barrel length and the barrel having a barrel axis that extends parallel to the length of the barrel. The breech valve may be structurally attached to the barrel at the launcher beech end of the barrel wherein the breech valve has a valve body with an exterior surface. The breech valve may have an internal rotary member, the rotary member having a cylindrical or spherical shape, the rotary member shape having a cylindrical or spherical diameter, and wherein the rotary member is capable of being rotated over an angle that ranges at least between at least 0 to 90 degrees. The rotary member may have a through-hole, the through-hole extending through the diameter of the rotary member, the through-hole having a through-hole axis that is located at the center of the cross section area of the through-hole and extends along the length of the through hole. The rotary member provides line-of-sight communication from the exterior surface of the breech valve to the barrel chamber such that when the breech valve is in the valve full open position and when the through-hole axis is rotationally aligned parallel with the barrel axis and when at the valve full open position, a continuous passageway opening extending from the external surface of the breech valve through the full length of the barrel chamber is provided. The rotary member may provide blocked line-of-sight communication from the exterior surface of the breech valve to the barrel chamber when the valve is in the full closed position when the through-hole axis is rotationally aligned perpendicular to the barrel axis; and the rotary member may have an attached rotary member that may be manually rotated to open or close the valve. The apparatus may have the rotary member comprises a lever outside of the chamber such that rotation of the lever rotates the rotary member and the angular position of the lever with respect to the barrel chamber indicates the angle at which the rotary member is positioned relative to the barrel axis.

Another alternative description for the apparatus for the launching of bottle rockets comprises: a hollow barrel chamber, a port allowing insertion of a bottle rocket into the chamber, a port closure system that closes with sufficient security that propulsive forces from launch of a bottle rocket will not open the port closure system, a support system for the apparatus that allows at least three-point contact of the support with the ground, and the support system comprising at least three arms, and at least one of the arms being rotatable and/or telescopic to enable angling of the hollow barrel chamber relative to the ground. The apparatus may have the port comprises a side breech opening with locking features to secure the port upon closure. The apparatus may have the port with dimensions parallel to the hollow barrel chamber that allows insertion of a rocket without any flexing of the rocket. The apparatus may have the port with a length that is at least 25 cm in length when open. The apparatus may have the port comprise an end breech system. With an end breech system, with the rocket thrust into the chamber, it is desirable to have the system resist backsliding of the rocket (lit usually with a back breech system) towards the breech opening. To accomplish this, at least a portion of internal surface on the hollow chamber closest to the end breech system has a coefficient of friction with regard to soft wood that prevents a cylindrical 0.5 mm per side square soft wood stick lying on the surface at an angle of 37° from accelerating towards the breech end at greater than 0.2 ft/sec$^2$, which is about 0.1 times normal gravity acceleration on Earth.

What is claimed is:

1. A bottle rocket launcher apparatus for use on a ground surface comprising a barrel and a breech valve having a full open position and a full closed position, the launcher having a launcher breech end and a barrel muzzle end;

a) the barrel comprising a hollow tube having an inside surface, the barrel having a barrel chamber that compromises all of the inside surface of the barrel, the barrel having a barrel length and the barrel having a barrel axis that extends parallel to the length of the barrel;

b) the breech valve being structurally attached to the barrel at the launcher beech end of the barrel wherein the breech valve has a valve body with an exterior surface;

c) the breech valve having an internal rotary member, the rotary member having a cylindrical or spherical shape, the rotary member shape having a cylindrical or spherical diameter, and wherein the rotary member is capable of being rotated over an angle that ranges at least between 0 to 90 degrees;

d) the rotary member having a through-hole, the through-hole extending through the diameter of the rotary member, the through-hole having a through-hole axis that is located at the center of the through-hole and extends along the length of the through hole;

e) the rotary member providing line-of-sight communication from the exterior surface of the breech valve to the barrel chamber such that when the breech valve is in the valve full open position and when the through-hole axis is rotationally aligned parallel with the barrel axis and when at the valve full open position, a continuous passageway opening extending from the external surface of the breech valve through the full length of the barrel chamber is provided;

f) the rotary member providing blocked line-of-sight communication from the exterior surface of the breech valve to the barrel chamber when the valve is in the full closed position when the through-hole axis is rotationally aligned perpendicular to the barrel axis; and g) the rotary member having an attached rotary member lever that may be manually rotated to open or close the valve.

2. The apparatus of claim 1 wherein the rocket launcher has a cylindrical shaped barrel, a barrel cylindrical inside surface shape, a barrel inside diameter, a barrel outside diameter wherein the barrel inside diameter is at least 60% of the barrel outside diameter.

3. The apparatus of claim 1 wherein the rocket launcher has three support legs wherein the launcher breech end of the launcher is supported with a single breech leg and the launcher barrel end of the launcher is supported by two individual barrel legs wherein the three legs form a three-point launcher support at a launcher location that aligns the barrel axis at a launcher incline angle that ranges from 30 to 90 degrees wherein the angle is measured from the ground surface at the launcher location wherein one end of each of the three legs is attached to the rocket launcher and the opposite end of each leg is capable of being manually moved in space relative to the rocket launcher apparatus.

4. The apparatus of claim 3 wherein all three of the rocket launcher support legs are positioned on the ground surface with sufficient distance between each leg, wherein the distance is measured at the location where each leg contacts the ground to provide stable structural support of the launcher.

5. The apparatus of claim 3 wherein the breech leg is attached to the launcher apparatus with a mounting fastener that allows the breech leg to be rotated or otherwise moved, manually into positions that allow an elevation of the breech end of the launcher to be adjusted relative to the ground surface at the launcher location.

6. The apparatus of claim 3 wherein the barrel legs are attached to the launcher apparatus with mounting fasteners and barrel clamps that allow the legs to be moved manually into positions that allow an elevation of the muzzle end of the launcher to be adjusted relative to the ground surface at the launcher location to provide a desired launcher incline angle.

7. The apparatus of claim 3 wherein the three support legs attached to the launcher apparatus are attached to the launcher apparatus with fasteners and clamps that allow all three legs to be rotated and moved into launcher storage positions wherein all three legs lay directly adjacent to and parallel to the launcher barrel.

8. The apparatus of claim 1 wherein a rotary member lever has a return spring that allows the rotary member to be manually rotated to a desired rotary member angle wherein a valve passageway to the barrel chamber is opened but wherein the spring automatically returns the rotary member to a valve-closed position when manual force is removed from the rotary member lever.

9. The apparatus of claim 1 wherein a rotary member lever has a return spring that is an over-center spring that provides two extreme lever positions to a breech valve manually operated valve lever wherein at one extreme lever position the breech valve is at a full open position and at the second extreme lever position the breech valve is at a full closed position.

10. The apparatus of claim 1 wherein the rotary member comprises a lever outside of the chamber such that rotation of the lever rotates the rotary member and an angular position of the lever with respect to the barrel chamber indicates an angle at which the rotary member is positioned relative to the barrel axis.

* * * * *

UNITED STATES PATENT AND TRADEMARK OFFICE

CERTIFICATE OF CORRECTION

PATENT NO. : 7,237,488 B2
APPLICATION NO. : 11/066916
DATED : July 3, 2007
INVENTOR(S) : Cameron Michael Duescher It is certified that error appears in the above-identified patent and that said Letters Patent is hereby corrected as shown below:

Title page, Inventors (76), should read as sole inventor: -- Cameron Michael Duescher, 276 Janice Ave., Shoreview, MN (US) 55126 --

Title Page, Item (12), Delete "Duescher et al." and replace with -- Duescher --.

Signed and Sealed this

Fourth Day of March, 2008

JON W. DUDAS
*Director of the United States Patent and Trademark Office*